US009384717B2

(12) United States Patent
Yamauchi et al.

(10) Patent No.: US 9,384,717 B2
(45) Date of Patent: Jul. 5, 2016

(54) TONE GENERATION ASSIGNING APPARATUS AND METHOD

(71) Applicant: YAMAHA CORPORATION, Hamamatsu-shi (JP)

(72) Inventors: Akira Yamauchi, Hamamatsu (JP); Masahiro Kakishita, Hamamatsu (JP); Tomoko Okumura, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/420,061

(22) PCT Filed: Aug. 9, 2013

(86) PCT No.: PCT/JP2013/071718
§ 371 (c)(1),
(2) Date: Feb. 6, 2015

(87) PCT Pub. No.: WO2014/025041
PCT Pub. Date: Feb. 13, 2014

(65) Prior Publication Data

US 2015/0170624 A1 Jun. 18, 2015

(30) Foreign Application Priority Data

Aug. 9, 2012 (JP) ..... 2012-176567

(51) Int. Cl.
*G10H 1/00* (2006.01)
*G10H 1/18* (2006.01)
(Continued)

(52) U.S. Cl.
CPC ..... *G10H 1/0008* (2013.01); *G10H 1/10* (2013.01); *G10H 1/186* (2013.01); *G10H 1/22* (2013.01); *G10H 1/24* (2013.01); *G10H 2210/245* (2013.01)

(58) Field of Classification Search
CPC ..... G10H 1/186; G10H 1/06; G10H 7/00; G10H 7/006; G10H 1/0575; G10H 1/42; G10H 2210/066; G10K 15/02; G10K 15/04
See application file for complete search history.

(56) References Cited

U.S. PATENT DOCUMENTS 4,862,783 A * 9/1989 Suzuki ..... G10H 1/06 84/622
4,984,497 A * 1/1991 Inagaki ..... G10H 1/186 84/602

(Continued)

FOREIGN PATENT DOCUMENTS

JP 04216595 A 8/1992
JP 2565069 B2 12/1996

(Continued)

OTHER PUBLICATIONS

International Search Report issued in PCT/JP2013/071718, mailed Sep. 17, 2013. English translation provided.

(Continued)

*Primary Examiner* — Marlon Fletcher
(74) *Attorney, Agent, or Firm* — Rossi, Kimms & McDowell LLP

(57) ABSTRACT

Tone generating instructions designating one or more tone pitches are received in response to performance operation on a keyboard, for example. A plurality of assigners are provided to assign tone colors to the one or more tone pitches designated by the received tone generating instructions. The plurality of the assigners are configured to select, for each assignor, from among the one or more tone pitches designated by the one or more tone generation instructions received by a reception section, one or more target tone pitches to which the tone color is to be assigned by the assigner, and determine, for each assignor and on the basis of a priority order set for each assigner, from among the selected one or more target tone pitches, one or more tone pitches of which tones are to be generated with the tone color assigned by the assigner.

15 Claims, 5 Drawing Sheets

(51) Int. Cl.

| | |
|---|---|
| ***G10H 1/10*** | (2006.01) |
| ***G10H 1/24*** | (2006.01) |
| ***G10H 1/22*** | (2006.01) |

(56) References Cited

U.S. PATENT DOCUMENTS

| | | | | |
|---|---|---|---|---|
| 5,070,758 | A * | 12/1991 | Katada | G10H 1/0033 84/610 |
| 5,107,747 | A * | 4/1992 | Saito | G10H 1/186 84/655 |
| 5,214,229 | A * | 5/1993 | Mizuno | G10H 1/24 84/615 |
| 5,523,521 | A * | 6/1996 | Suzuki | G10H 1/186 84/615 |
| 5,895,877 | A * | 4/1999 | Tamura | G10H 1/0066 84/602 |
| 6,303,852 | B1 * | 10/2001 | Kizaki | G10H 1/0066 84/622 |
| 2001/0003940 | A1 * | 6/2001 | Kondo | G10H 1/186 84/1 |
| 2003/0172799 | A1 * | 9/2003 | Sakurai | G10H 7/02 84/622 |
| 2007/0068368 | A1 | 3/2007 | Hiramastu et al. | |
| 2009/0308231 | A1 * | 12/2009 | Mizuhiki | G10H 1/06 84/622 |
| 2010/0077907 | A1 | 4/2010 | Tanaka et al. | |
| 2010/0077908 | A1 | 4/2010 | Tanaka | |
| 2011/0219941 | A1 * | 9/2011 | Tsuchiya | G10H 1/0575 84/622 |
| 2014/0130655 | A1 * | 5/2014 | Fukada | G10K 15/02 84/622 |

FOREIGN PATENT DOCUMENTS

| | | | |
|---|---|---|---|
| JP | 2001184063 | A | 7/2001 |
| JP | 2005157200 | A | 6/2005 |
| JP | 2007093679 | A | 4/2007 |
| JP | 2010079178 | A | 4/2010 |
| JP | 2010079179 | A | 4/2010 |

OTHER PUBLICATIONS

Japanese Office Action issued in Japanese counterpart application No. JP2013-543431, dated Oct. 13, 2015. English translation provided.

European Search Report issued in European counterpart application No. EP13827155.6, dated Jan. 22, 2016.

* cited by examiner

| | TARGET DEPRESSED KEY | PRIORITY RULE | NUMBER OF TONE | TONE COLOR |
|---|---|---|---|---|
| ASSIGNER 1 | ALL | HIGHER-PITCH NOTE PRIORITY | 1 | TRUMPET |
| ASSIGNER 2 | ALL BUT HIGHEST-PITCH NOTE | HIGHER-PITCH NOTE PRIORITY | 1 | TRUMPET |
| ASSIGNER 3 | THREE DEPRESSED NOTES FROM HIGHEST-PITCH NOTE | LOWER-PITCH NOTE PRIORITY | 1 | TROMBONE |
| ASSIGNER 4 | TWO DEPRESSED NOTES FROM LOWEST-PITCH NOTE | HIGHER-PITCH NOTE PRIORITY | 1 | TENOR SAX |
| ASSIGNER 5 | ALL | LOWER-PITCH NOTE PRIORITY | 1 | BARITONE SAX |

F I G. 4

| | RANGE | OUTSIDE-RANGE NOTE PROCESSING | VOLUME |
|---|---|---|---|
| TRUMPET | E2－B♭4 | SOUNDED AS DESIGNATED | 100 |
| TROMBONE | E1－C4 | SOUNDED AS DESIGNATED | 64 |
| TENOR SAX | G♯1－E♭4 | OCTAVE SHIFT | 64 |
| BARITONE SAX | D1－F♯3 | OCTAVE SHIFT | 42 |

F I G. 5

KEY DEPRESSION STATE (PERFORMANCE OPERATION)

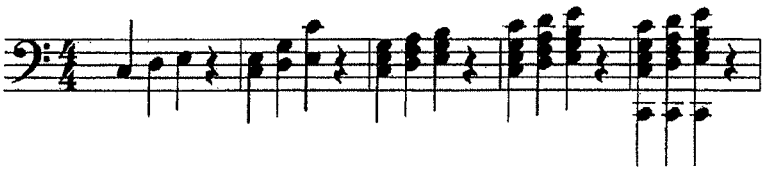

F I G. 6

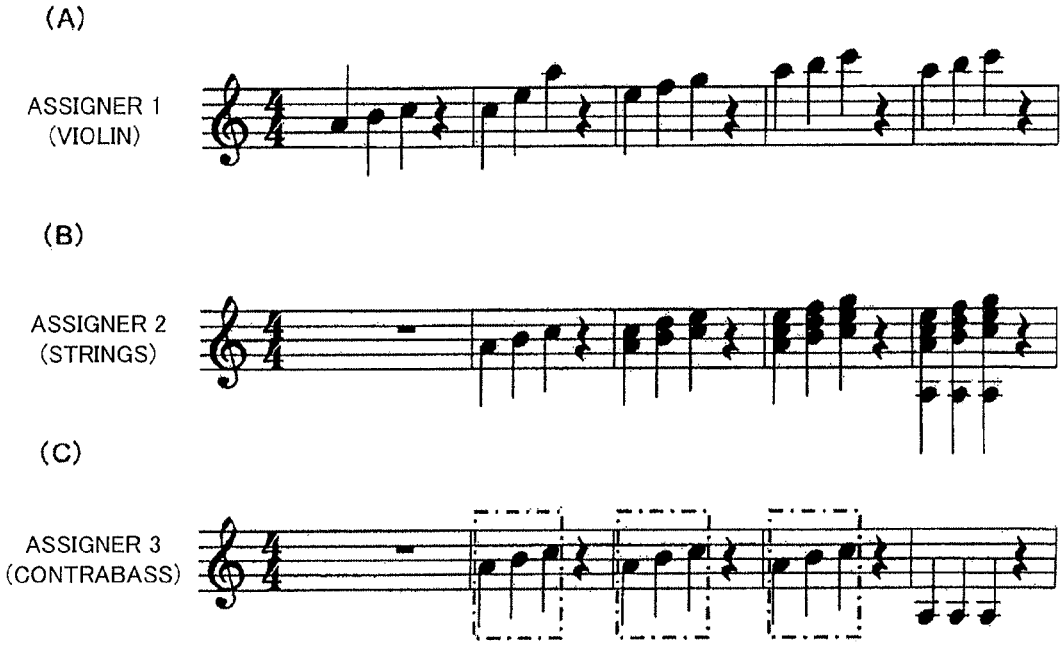

FIG. 9

| | TARGET DEPRESSED KEY | PRIORITY RULE | NUMBER OF TONES | TONE COLOR |
|---|---|---|---|---|
| ASSIGNER 1 | ALL | HIGHER-PITCH NOTE PRIORITY | 1 | VIOLIN |
| ASSIGNER 2 | ALL BUT HIGHEST-PITCH NOTE | LAST-DEPRESSED KEY PRIORITY | LIMITLESS | STRINGS |
| ASSIGNER 3 | ALL BUT HIGHEST-PITCH NOTE | LOWER-PITCH NOTE PRIORITY | 1 | CONTRABASS |

FIG. 10

| | RANGE | OUTSIDE-RANGE NOTE PROCESSING | VOLUME |
|---|---|---|---|
| VIOLIN | G2—A5 | SOUNDED AS DESIGNATED | 100 |
| STRINGS | — | — | 64 |
| CONTRABASS | E0—F3 | IGNORED (NOT SOUNDED) | 64 |

FIG. 11

TONE GENERATION ASSIGNING APPARATUS AND METHOD

TECHNICAL FIELD

The present invention relates to tone generation assigning apparatus and method, and it more particularly relates to a program executable by a processor and a non-transitory computer-readable storage medium storing such a program, as well as an electronic musical instrument.

BACKGROUND ART

There have heretofore been known electronic musical instruments which are constructed to allocate or assign any one of a plurality of tone colors (or timbres) to a tone pitch corresponding to a musical note (scale note) performed by depressing a key on a keyboard or the like and generate a tone of the tone pitch with the assigned tone color. In this connection, there have also been known techniques pertaining to an assigner (key assigner) for assigning which tone colors are to be sounded in response to which key depressions (tone pitches).

Among examples of such techniques is one arranged to provide various tone effects, such as dual, split and solo, by a combination of two assigners (see, for example, Patent Literature 1). According to the technique disclosed in Patent Literature 1, each of the assigners controls which tone color should be sounded with what kind of assignment rule (last-depressed key priority or higher-pitch note priority), and up to how many depressed keys are allowed to be sounded.

Also known is a technique which is arranged to provide a tone effect as if four human players are executing an ensemble performance by assigning, in accordance with the number of simultaneously depressed keys, tones of four performance parts (tone colors) equally to tone pitches of the individual depressed keys and causing the tone-color-assigned tones to be generated or sounded (see, for example, Patent Literature 2). More specifically, according to the technique disclosed in Patent Literature 2, the performance parts have respective priorities (priority ranks) corresponding their tone pitches, and these performance parts are assigned to depressed keys, in a high-tone-pitch to low-tone-pitch direction i.e. in an order from "performance part 1" to "performance part 4", in such a manner that the number of the performance parts assigned is substantially equal among the depressed keys. For example, when the number of simultaneously depressed keys is one, a tone of a tone pitch corresponding to the one depressed key is generated (sounded) simultaneously in the four performance parts (tone colors). Further, when the number of simultaneously depressed keys is two, a tone of a tone pitch corresponding to one of the depressed keys is generated simultaneously in two of the performance parts (with two tone colors), and a tone of a tone pitch corresponding to the other of the depressed keys is generated simultaneously in the other two of the performance parts (with other two tone colors). Furthermore, when the number of simultaneously depressed keys is four, tones of different tone pitches corresponding to the four depressed keys are generated respectively in the four performance parts (with different tone colors); that is, a tone of a different tone pitch is generated per performance part (with a different tone color).

PRIOR ART LITERATURE

Patent Literature 1: Japanese Patent No. 2565069

Patent Literature 2: Japanese Patent Application Laid-open Publication No. 2010-079179

In an ensemble performance (e.g., quartet), the technique disclosed in Patent Literature 2 assigns a predetermined number of performance parts (e.g., four performance parts) equally to individual depressed keys in accordance with the number of depressed keys, the tone generation may undesirably become unnatural depending on the tone colors and key depression state. If the number of depressed keys increases to exceed the number of the performance parts, for example, tones of the depressed keys would be generated with at least one of the performance part assigned to more than one depressed key, which tends to impart a strange or uncomfortable feeling as if the number of human players has increased suddenly (e.g., as if one trumpet player has increased to two).

Further, according to the prior art technique, all of the performance parts do not have their priorities and are merely assigned equally to the individual depressed keys in accordance with an order of tone pitches, and thus, an ensemble performance corresponding to respective characteristics of tone colors (musical instruments) cannot sometimes be realized. For example, although the number of simultaneously-generatable (simultaneously-soundable) tones differs between a trumpet and a piano, no appropriate control has heretofore been performed taking such a difference in characteristic into account.

Further, whereas all of human players (e.g., four human players) are not always generating tones in an ordinary ensemble performance, the prior-art technique is arranged in such a manner that tones are always generated in all of the four performance parts, thus imparting a strange or uncomfortable feeling. Thus, with the prior-art technique, where control is performed such that all of the performance parts (tone colors) are assigned equally in accordance with the number of depressed keys, an ensemble performance undesirably tends to become unnatural.

SUMMARY OF INVENTION

It is therefore an object to provide a technique which permits an ensemble performance that simultaneously generates tones of a plurality of tone pitches without imparting unnaturalness or a strange or uncomfortable feeling.

In order to accomplish the above-mentioned object, the present invention provides a tone generation assigning apparatus, which comprises: a reception section configured to receive one or more tone generation instructions designating one or more tone pitches; and a plurality of assigners each configured to assign a tone color to the one or more tone pitches designated by the one or more tone generation instructions received by said reception section, each of the assigners selecting, from among the one or more tone pitches designated by the one or more tone generation instructions received by the reception section, one or more target tone pitches to which the tone color is to be assigned by the assigner, each of said assigners determining, on the basis of a priority order set for the assigner, from among the selected one or more target tone pitches, one or more tone pitches of which tones are to be generated with the tone color assigned by the assigner.

The tone generation assigning apparatus of the present invention includes the plurality of assigners for assigning tone colors to the one or more tone pitches designated by the one or more tone generation instructions. In each of the assigners, the tone color to be assigned to the one or more tone pitches designated by the one or more tone generation instructions can be set independently of the tone colors to be set by the other assigners. Thus, by the individual assigners assigning their respective specific tone colors to the tone pitches designated by the tone generation instructions, the present invention advantageously allows a plurality of tones of different tone colors to be simultaneously generated in response to a tone generation instruction designating, for example, one tone pitch (one key depression). In the present invention, for each of the plurality of assigners, one or more target tone pitches to which the tone color is to be assigned by the assigner is selected from among the one or more tone pitches designated by the received one or more tone generation instructions, and one or more pitches of which tones are to be audibly generated (or sounded) with the tone color assigned by the assigner are determined, from among the selected target tone pitches, on the basis of the priority order set for the assigner. In this way, tone color assignment can be performed in a unique or specific manner for each of the assigners, and thus, the present invention can advantageously achieve flexible tone generation assignment. Further, in this case, it is possible to appropriately determine, for each of the assigners, both a "mode for selecting target tone pitches to which the tone color is to be assigned by the assigner" and a "mode for determining one or more tone pitches of which tones are to be generated with the tone color assigned by the assigner", with characteristic of the tone colors to be assigned by the individual assigners. Thus, the present invention permits an ensemble performance, where tones of a plurality of tone colors are simultaneously generated, with the respective characteristics of the tone colors taken into account and without imparting unnaturalness and an uncomfortable feeling.

BRIEF DESCRIPTION OF DRAWINGS

FIG. 4 shows an example of an assigner setting table employed in the embodiment of the present invention;

FIG. 5 shows an example of a setting table for outside-range note processing employed in the embodiment of the present invention;

FIG. 6 shows a musical score depicting example key depression states explanatory of allocation control processing performed in the embodiment of the present invention;

FIG. 9 shows musical scores showing respective tone generation states of assigners AS(1) to AS(3) as a result of the assignment control processing performed on the musical score shown in FIG. 8;

FIG. 10 shows another example of the assigner setting table employed in the embodiment of the present invention; and FIG. 11 shows another example of the setting table for outside-range note processing employed in the embodiment of the present invention.

DESCRIPTION OF EMBODIMENTS

Figure 1:
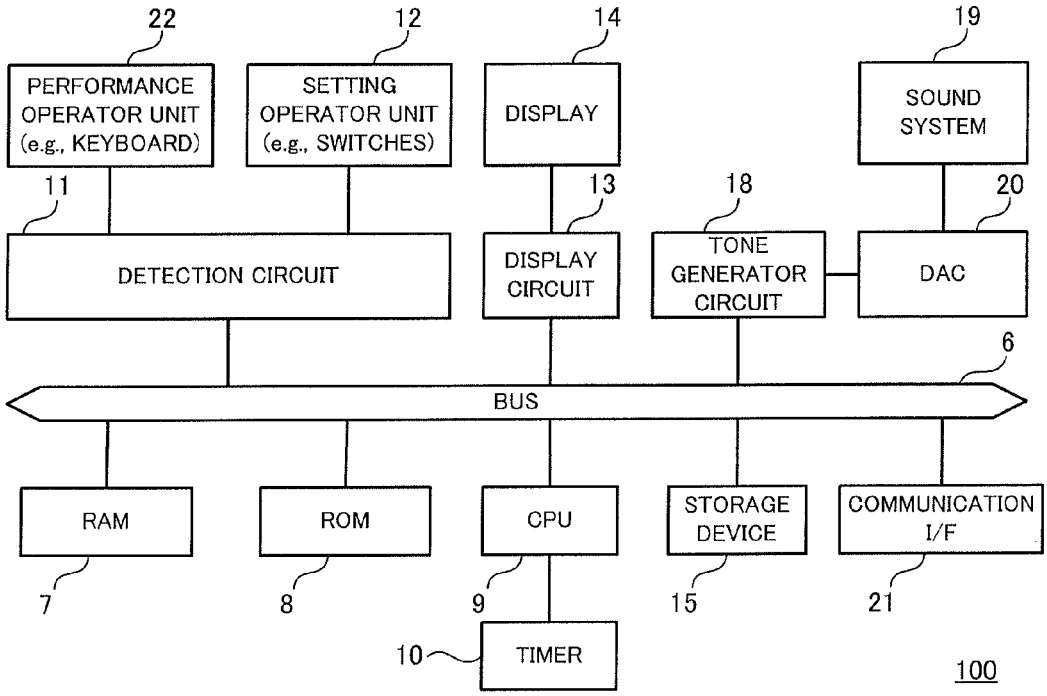
FIG. 1 is a block diagram showing an example hardware setup of an embodiment of an electronic musical instrument of the present invention.

FIG. 1 is a block diagram showing an example hardware setup of an embodiment of an electronic musical instrument 100 of the present invention. This electronic musical instrument 100 has incorporated therein a tone generation assigning apparatus constructed to carry out the present invention.

To a bus 6 of the electronic musical instrument 100 are connected a RAM 7, a ROM 8, a detection circuit 11, a display circuit 13, a storage device 15, a tone generator circuit 18 and a communication interface (I/F) 21.

The RAM 7 includes buffer areas including a reproduction buffer etc., flags, registers, and a working area to be used by the CPU 9 for storing various parameters etc.

The ROM 8 stores therein among other things: waveform data corresponding to tone colors and automatic performance data; various data files of automatic accompaniment data (accompaniment style data); various parameters and control programs; programs for implementing the instant embodiment; and various tables. Namely, a program for assigning tone generation in accordance with the present invention is prestored in the ROM 8 or in the storage device 15 to be detailed later.

The CPU 9 can execute the control programs stored in the ROM 8 or the storage device 15, the program for implementing the instant embodiment (i.e., tone generation assigning program), etc., and it performs various arithmetic operations and control on the apparatus in accordance with such programs. A timer 10 is connected to the CPU 9 so that a basic clock signal, interrupt processing timing, etc. are supplied to the CPU 9.

A user can make or select various input and settings by use of a setting operator unit 12 connected to the detection circuits 11. The setting operator unit 12 may be of any of desired types, such as switch, pad, fader, slider, rotary encoder, joystick, jog shuttle, text inputting keyboard and mouse types, as long as it can output signals responsive to input by the user. Further, the setting operator unit 12 may also be a software switch displayed on a display 14 for operation via another operator, such as a cursor switch. Further, a touch panel that detects a user's depression or touch operation on a panel operation surface, provided on the surface of the display 14, and outputs position information (i.e., x and y coordinates) indicative of a position of the user's operation on the surface of the display 14 can be used as the setting operator unit 12.

The display circuit 13 is connected to the display 14 and can cause the display 14 to display various information. The display 14 can display, among other things, various information for setting the electronic musical instrument 100.

Further, the storage device 15 comprises at least one of combinations of storage media, such a hard disk, an FD (Flexible Disk or Floppy Disk (registered trademark), a CD (Compact Disk), a DVD (Digital Versatile Disk) and a semiconductor memory like a flash memory, and drive devices for the storage media.

The tone generator circuit 18 generates a tone signal in accordance with waveform data, audio data, automatic accompaniment data or automatic performance data stored in the storage device 15, ROM 8, RAM 7 or the like, or a performance signal, a MIDI signal, phrase waveform data or the like supplied from a performance operator unit (e.g., keyboard) 22 or external equipment or the like connected to the communication interface (I/F) 21, and then the tone generator circuit 18 imparts any of various musical effects to the generated tone signal and supplies the effect-imparted tone signal to a sound system via a DAC 20. The DAC 20 converts the tone signal of a digital format into an analog format, and the sound system 19 includes an amplifier and a speaker and audibly generates or sounds the DA-converted tone signal. The tone generator circuit 18 is constructed, for example, as a tone generator capable of generating tones in a plurality of channels.

The communication interface 21 comprises at least one of various communication interfaces and music-only communication interfaces, such as a general-purpose short distance wired I/F like the USB or IEEE1394, a general-purpose network I/F like the Ethernet (registered trademark), a general-purpose I/F like the MIDI I/F, and a general-purpose short distance wireless I/F like a wireless LAN and the Bluetooth (registered trademark), and the communication interface 21 can communicate with external equipment, servers, etc.

The performance operator unit (e.g., keyboard) 22 is connected to the detection circuit 11, supplies performance information (performance data) in response to a user's performance operation. The performance operator unit 22, which is operable to input a performance by the user, receives in real time a user's tone generation instructing operation. The detection circuit 11 detects turning-on and turning-off of individual operators (individual keys) of the performance operator unit (e.g., keyboard) 22 and outputs key-on and key-off signals (or note-on and note-off events) in such a data format as to permit identification of musical notes, i.e. tone pitches, corresponding to user-operated operators (keys) and as to permit identification of operation start and end times of the user's operations of the operators. Such key-on and key-off signals (or note-on and note-off events) thus output from the performance operator unit (e.g., keyboard) 22 are supplied to the CPU 9 via the bus 6. Further, as known in the art, various parameters, such as a velocity value, corresponding to a manner or style of the user's operation of the performance operator unit (e.g., keyboard) 22 can be input to the CPU 9. Whereas the instant embodiment of the invention is described here as including the keyboard-type performance operator unit 22, the present invention is not necessarily so limited. As an example, the performance operator unit 22 functions as a reception section (later-described tone generation instruction reception section 32) that receives one or more instructions for generating tones of one or more desired tone pitches, i.e. one or more tone generation instructions designating one or more desired tone pitches.

Note that the instant embodiment of the electronic musical instrument may be constructed as a music apparatus having no performance operator unit or as electronic equipment other than a music apparatus, in which case a performance operator unit is connected to the music apparatus or electronic equipment. Alternatively, the embodiment may be constructed to receive, as one or more instructions for generating tones of one or more desired tone pitches (tone generation instructions designating one or more desired tone pitches), not only performance data based on a user's real time performance on the performance operator unit but also performance data based on an automatic performance executed by an automatic performance apparatus. Further, the display 14, the sound system 19, etc. are also replaceable with external equipment. Furthermore, other structural elements may be added or any of the aforementioned structural elements may be dispensed with as appropriate.

Figure 2:
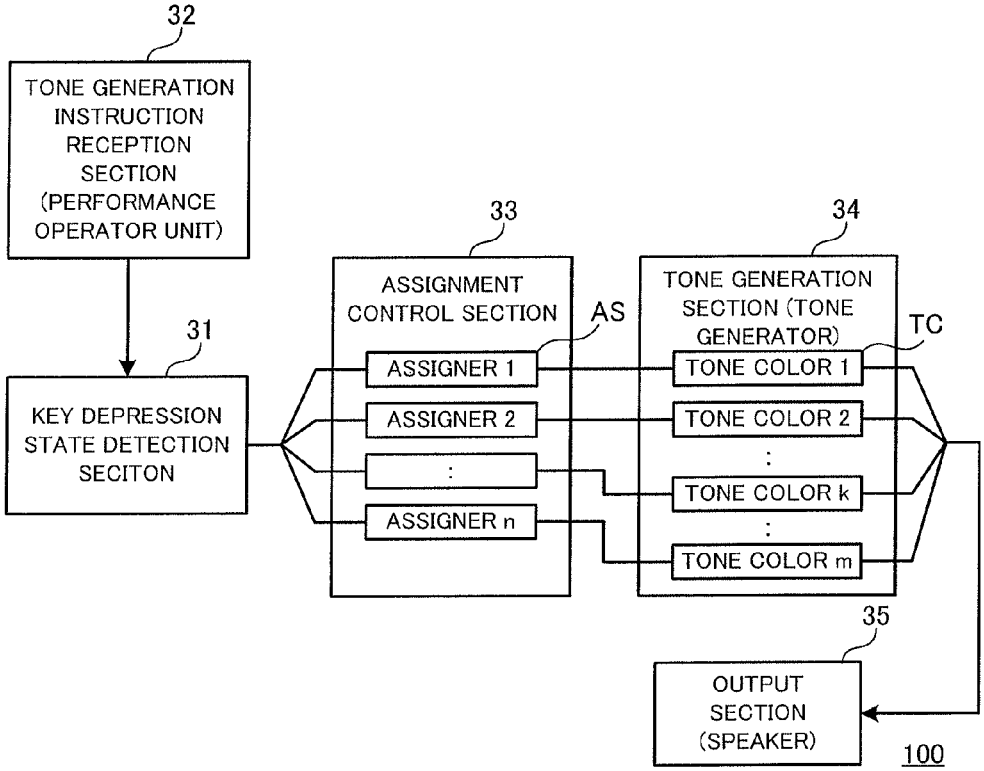
FIG. 2 is a block diagram explanatory of a function performed in the embodiment of the electronic musical instrument of the present invention.

FIG. 2 is a block diagram explanatory of an assignment control function of the embodiment of the electronic musical instrument 100 of the present invention (i.e., function as a tone generation assigning apparatus).

The electronic musical instrument 100 includes the above-mentioned tone generation instruction reception section 32, a key depression state detection section 31, an assignment control section 33, a tone generation section (tone generator) 34 and an output section 35.

In the illustrated embodiment, the tone generation instruction reception section 32, which is implemented by the performance operator unit 22 of FIG. 1, is a keyboard-type performance operator unit. The tone generation instruction reception section 32 receives a user's tone generation instruction, i.e. one or more tone generation instructions for generating tones of one or more desired tone pitches. For example, in response to depression of any one of keys of the keyboard that is the performance operator unit 22, the tone generation instruction reception section 32 receives input of a performance signal corresponding to the depressed key and supplies the input performance signal to the key depression state detection 31 provided at a subsequent stage.

Note that the tone generation instruction reception section 32 may be constructed to receive an operation of a performance operator unit, which is of a string instrument type, a wind instrument type or the like other than the keyboard type, of the electronic musical instrument, or note-on/note-off data (note-on/note-off events) from the outside via the communication I/F. Further, the tone generation instruction reception section 32 may be constructed to reproduce automatic performance data, such as sequence data.

Further, the key depression state detection section 31 acquires a note No. (tone pitch) of a currently depressed key on the basis of the performance signal supplied from the tone generation instruction reception section 32 and supplies the acquired note No. to the assignment control section 33, provided at a subsequent stage, together with a key-on signal (note-on event). Further, as known in the art, once a key having so far been depressed is released, the key depression state detection section 31 may supply a note No. of the released key to the assignment control section 33 together with a key-off signal (note-off event).

The assignment control section 33 includes a plurality of assigners AS(1) to AS(n), and each of the plurality of assigners AS(1) to AS(n) assigns, to a note No. (tone pitch) supplied from the key depression state detection section 31, a tone color specific to the assigner. More specifically, each of the assigners AS(1) to AS(n) determines, on the basis of note Nos. (tone pitches) and order of corresponding depressed keys (i.e., order of tone generation instructions) supplied from the key depression state detection section 31, of which of all performance operations (all depressed keys) a tone of a tone pitch corresponding to that performance operation should be generated or sounded via the assigner (i.e., to which of the performance operations (depressed keys) the tone color set for the assigner is to be assigned, and it supplies the tone generation section 34 with tone pitch information that is indicative of the tone pitch having been determined to be sounded. Note that, in the figure, the assigners AS(1) to AS(n) are depicted as "assigner 1" to "assigner n" for convenience. Note that assignment control processing performed by the assignment control section 33 for assigning the tone colors of the assigners AS to tones of tone pitches of performance operations (depressed keys) will be described later with reference to FIG. 3.

The tone generation section 34 (corresponding to the tone generator, i.e. the aforementioned tone generator circuit 18) generates tone signals of tone pitches corresponding to performance operations (depressed keys), determined by the individual assigners AS, with tone colors TC1 to TCm assigned by the assigners AS. The thus-generated tone signals are audibly generated or sounded via the output section (speaker) 35. For example, the tone generation section 34 is capable of generating tone signals of desired tone pitches in a plurality of channels, as known in the art. Each of the assigners AS instructs any one or more of the channels of the tone generation section 34 to generate tone signals of one or more tone pitches determined to be sounded by the assigner with the tone color assigned by the assigner, so that the tones signals are sounded with the assigned tone color via the one or more channels.

Figure 3:
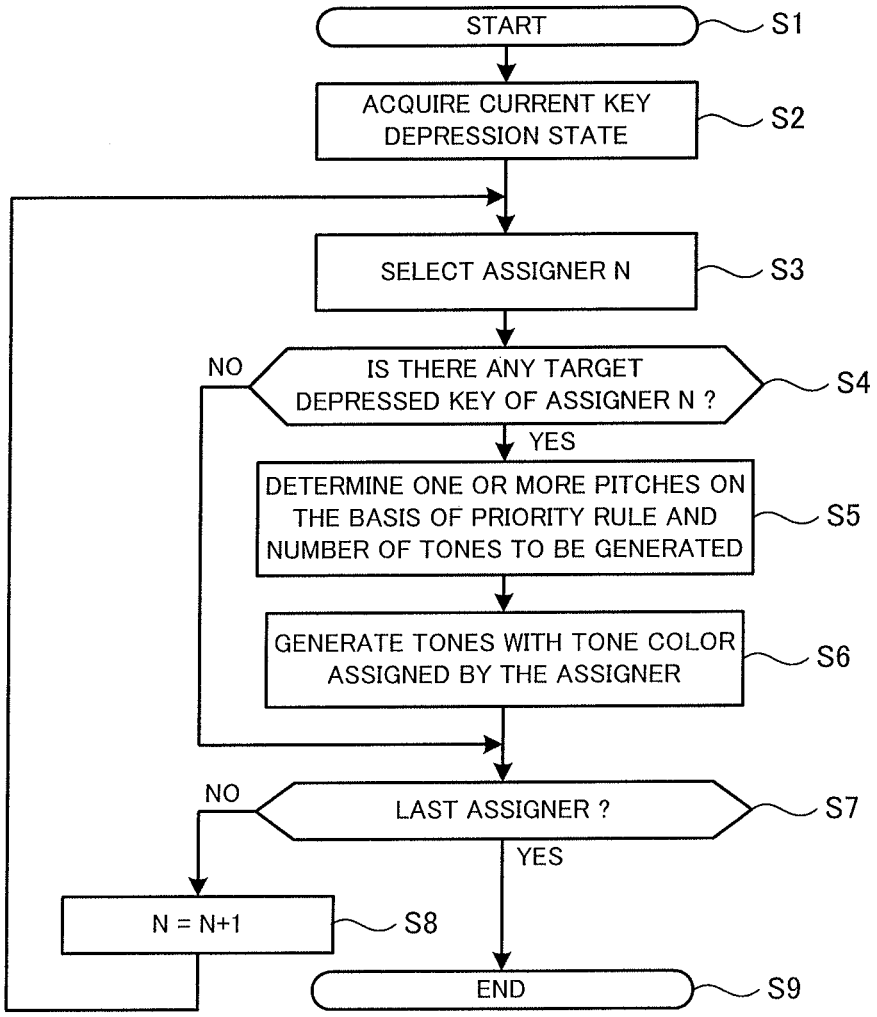
FIG. 3 is a flow chart showing assignment control processing performed in the embodiment of the electronic musical instrument of the present invention.

FIG. 3 is a flow chart showing the assignment control processing performed in the instant embodiment of the present invention. The assignment control processing is arranged such that an assignment process for generating, with some tone color, tone signals corresponding to one or more desired tone pitches designated by one or more tone generation instructions received by the tone generation instruction reception section 32 of FIG. 2 in response to a performance operation is performed via each of the assigners AS(1) to AS(n) of the assignment control section 33. Let it be assumed here that the electronic musical instrument 100 in the illustrated example includes, as the performance operator unit 22, a keyboard having a plurality of keys.

The assignment control processing is started up at step S1 in response to detection of a change in the key depression state, e.g. when the tone generation instruction reception section 32 of FIG. 2 has received a new tone generation instruction, more specifically, each time a note-on or note-off event has been received. Note that the assignment control processing may be started only when a note-on event has been received and may be not started when a note-off event has been received.

At next step S2, a current key depression state (i.e., current performance operation state) is acquired. Here, the "key depression state (performance operation state)" indicates tone pitches of individual currently depressed keys (currently performed notes) and a key depression order in which the keys have been depressed (the notes have been performed). Such a key depression order will be required, for example, in a case where a later-described priority rule is based on a "last-depressed key priority". Each time the performance operator unit 22 is operated, information as to which of the keys has been depressed (or released) (hereinafter referred to as "key depression state") is sequentially stored into the RAM 7, so that the currently depressed key (tone pitch) and a position, in a key depression order, of the depressed key can be known by reference to the stored information (key depression state) stored in the RAM 7. Note that such a key depression order may be dispensed with if it is not used.

Operations of steps S4 to S6 are tasks of the assignment process performed by one of the assigner AS. Such assignment process tasks at steps S4 to S6 are sequentially performed for each of the assigners AS, so that tone generation assignment processes are performed by the plurality of assigners AS practically in a parallel fashion. First, at step S3, one assigner AS(N) that should perform the current assignment process tasks is selected from among the plurality of assigners AS. "N", which is set at a value "1" (N=1) at the start of the assignment process, is incremented by one at a later-described step S8, and the incrementing of "N" is repeated until the value of "N" equals the total number of the assigners AS. Namely, the assigner AS(1) is selected when the assignment process is performed for the first time, and then the other assigners AS(2), AS(3), AS(4), . . . , AS(n) are sequentially selected when the assignment process is performed for the second and subsequent times.

At next step S4, a determination is made, on the basis of the key depression state acquired at step S2, as to whether there is any target depressed key to be assigned by the assigner AS(N) selected at step S3. Such a determination as to whether there is any target depressed key to be assigned by the assigner AS(N) is made, for example, with reference to an assigner setting table shown in FIG. 4.

FIG. 4 shows an example of the assigner setting table. In this assigner setting table, "target depressed key", "propriety rule", "number of tones to be generated" and "tone color" are defined for each of the assigners AS. Note that the assigners AS(1) to AS(5) are shown in FIG. 4 as "assigner 1" to "assigner 5" for convenience.

The "target depressed key" defines one or more depressed keys to be assigned by the assigner AS in question, in accordance with which each particular depressed key to which a tone pitch is to be assigned by the assigner AS is selected from among all of the depressed keys. For example, the "target depressed key" is "all" (all depressed keys), "all but the highest-pitch depressed key (or note)", "three depressed keys (notes) from the highest-pitch depressed key (note)", "two keys (notes) from the lowest-pitch depressed key (note)", or the like. Further, there may be prepared other parameters, such as "select * keys (notes) from the last-depressed key", "ignore * keys from the first-depressed key", etc. Namely, in the "target depressed key" column in the assigner setting table is defined, for each of the assigners, a condition for selecting any of the one or more tone pitches, designated by the one or more tone generation instructions, to which a tone color is to be assigned by the assigner.

The "priority rule" defines, for each of the assigners AS, a priority order for determining, from among the target depressed keys (tone pitches) of the assigner AS, one or more depressed keys (tone pitches) to be actually generated or sounded; namely, a predetermined number of depressed keys (tone pitches) are selected in accordance with the priority order. In the case of "higher-pitch note priority", tone pitches corresponding to the number of tones to be generated are selected sequentially from the highest tone pitch of the "target depressed keys". In the case of "lower-pitch note priority", tone pitches corresponding to the "number of tones to be generated" are selected sequentially from the lowest tone pitch of the "target depressed keys". Further, in the case of "last-depressed key priority", tone pitches corresponding to the "number of tones to be generated" are selected from the last key, in a tone generation order, of the "target depressed keys". Further, in the case of "first-depressed key priority", tone pitches corresponding to the "number of tones to be generated" are selected sequentially from the first depressed key, in the tone generation order, of the "target depressed keys".

The "number of tones to be generated" defines the number of tones simultaneously generatable (i.e., simultaneously soundable) via the assigner SA in question (i.e., the number of simultaneously generatable or soundable tones). The "tone color" indicates a specific tone color to be assigned by the assigner AS in question to the one or more tone pitches designated by the one or more tone generation instructions. Namely, the "tone color" column in the assigner setting table defines a tone color to be assigned by the assigner AS in question. Further, for each of the assigners, a combination of the "priority rule" column and the "number of tones to be generated" (number of simultaneously generatable tones) column defines a narrowing-down priority order for narrowingly determining one or more tone pitches of which tones are to be generated with the tone color assigned by the assigner AS. Note that each of the aforementioned parameters can be set different in value among the assigners AS. Of course, the parameters need not necessarily differ in value among the assigners as long as they can be set independently for each of the assigners AS. For example, the "number of tones to be generated" may be defined in accordance with the number of simultaneously generatable tones specific to a musical instrument type corresponding to the specific tone color assigned by the assigner AS in question. For example, for each assigner AS that assigns a wind instrument tone color of a monophonic tone generation type, it is preferable that the number of simultaneously generatable tones be set at "1"; the present invention can realize such preferable tone generation assignment. The aforementioned assigner setting table is prestored in the storage device 15 or the like. Note that a specific example of application of such a assigner setting table will be described later with reference to FIGS. 6 and 7.

With reference back to FIG. 3, the assignment control processing will be further described. If there is any target depressed key as determined at step S4, control proceeds to step S5 as indicated by an arrow of YES, but if there is no target depressed key as determined at step S4, control branches to step S7 as indicated by an arrow of NO. If the "target depressed key" is "all but *" (i.e., if a predetermined number of tone pitches are to be excluded or ignored), the target depressed keys may sometimes be determined to be "none", but if the "target depressed key" is "all", or "* depressed notes from the highest (lowest)-pitch note", then the "target depressed keys" is always determined to be "present". The operation of step S4 corresponds to a process for selecting, per assigner AS and from among the one or more tone pitches designated by the one or more tone generation instructions received by the tone generation instruction reception section 32, one or more target tone pitches to which a tone color is to be assigned by the assigner AS. As an example, each of the assigners AS is constructed to select, in accordance with a selection rule preset for the assigner AS and from among the one or more tone pitches designated by the one or more tone generation instructions received by the tone generation instruction reception section 32*a*, a predetermined number of tone pitches sequentially from the highest tone pitch or the lowest tone pitch (i.e., in a descending or ascending order of tone pitches) as targets to which the tone color is to be assigned by the assigner AS. As another example, each of the assigners AS is constructed to select, in accordance with a selection rule preset for the assigner AS and from among the one or more tone pitches designated by the one or more tone generation instructions received by the tone generation instruction reception section 32*a*, remaining tone pitches obtained after excluding a predetermined number of tone pitches sequentially from the highest tone pitch or the lowest tone pitch as targets to which the tone color is to be assigned by the assigner AS.

At next step S5, with reference to the assigner setting table and on the basis of the "priority rule" and the "number of tones to be generated" of one (Nth) assigner AS(N) selected at step S3, a tone pitch (depressed key) to be generated by the assigner AS(N) is selected and determined from among the target depressed keys determined at step S4. The operation of step S5 corresponds to a process for determining, per assigner AS and on the basis of the priority order (i.e., combination of the "priority rule" and the "number of tones to be generated") set for the assigner AS, one or more tone pitches of which tones are generated with the tone color assigned by the assigner AS from among the selected target tone pitches.

At next step S6, the tone generation section 34 is instructed to generate tones, corresponding to the one or more tone pitches (depressed keys) determined at step S5 above, with the tone color assigned by the assigner AS(N). In response to such an instruction, tone signals, corresponding to the one or more tone pitches (depressed keys) determined at step S5, are generated in one or more channels of the tone generation section 34 with the tone color assigned by the assigner AS(N).

At next step S7, a further determination is made as to whether the currently selected assigner AS(N) is the last one of the assigners; in this case, whether or not "N" is equal to the total number of the assigners AS is determined. If "N" is equal to the total number of the assigners AS, it means that the currently selected assigner AS(N) is the last one of the assigners, and thus, control proceeds to step S9 as indicated by a "YES" arrow, where the instant assignment control processing is brought to an end. If, on the other hand, "N" is not equal to the total number of the assigners AS, it means that the currently selected assigner AS(N) is not the last one of the assigners, control branches to step S8 as indicated by a "NO" arrow. At step S8, "N" is incremented by one (N=N+1), after which control revers to step S3 to repeat the aforementioned operations at and after step S3.

FIG. 5 shows an example of a setting table for outside-range note processing (outside-range note processing setting table) used in the instant embodiment of the present invention.

Generally, whereas ranges (tone pitch ranges) of tones generatable or soundable by raw musical instruments (natural musical instruments) are limited, electric musical instruments can generate tones of ranges that cannot be generated by raw musical instruments. For this purpose, in the instant embodiment, processing to be performed in response to a tone generation instruction designating an outside-range tone pitch can be defined per tone color in the outside-range note processing setting table shown in FIG. 5.

In the outside-range note processing table are set, for example, tone colors, ranges of the tone colors, outside-range note processing, tone volumes, etc. The outside-range note processing is a parameter that defines how to deal with an outside-range tone pitch when there has been given a tone generation instruction designating the tone pitch outside the range specified by a range parameter. Among examples of such an outside-range note processing parameter are "sounded as designated" and "octave shifted". In the case of "octave shifted", a tone of the tone pitch is generated after an octave shift (tone pitch conversion) being performed such that the designated outside-range tone pitch falls within the range. In the illustrated example of FIG. 5, a range of a tone color of "trumpet" is defined as "E2-B♭4", so that, when there has been given a tone generating instruction designating a tone pitch outside the range, the tone pitch is "sounded as designated". Further, a volume of the "trumpet" tone color is set at "100". A range of a tone color of "tenor sax" is defined as "G#1-E♭4", so that, when there has been given a tone generating instruction designating a tone pitch outside that range, the tone pitch is "octave shifted". Further, a volume of the "tenor sax" tone color is set at "64". By thus presetting volumes of the individual musical instruments, the instant embodiment can generate tones with real volume balance (i.e., with volume balance just as in an ensemble performance by raw musical instruments). Note that a volume with which a tone is generated may be determined in accordance with a value obtained by multiplying the preset volume by a key depression intensity (velocity).

By presetting the outside-range note processing as noted above, the instant embodiment can achieve a more natural ensemble performance with respective characteristics of natural musical instruments taken into account. Such outside-range note processing can be implemented by a computer program executable by the CPU 9. Namely, for each of the assigners, the outside-range note processing functions as a control section for controlling a tone generation mode. Namely, in a case where the one or more tone pitches having been determined to be generated as tones with the tone color assigned by the assigner are outside the tone-generatable range of the tone color assigned by the assigner, the outside-range note processing functions as the control section that controls the tone generation mode of the tones corresponding to the tone pitches. As an example, the function of the control section (outside-range note processing) may be arranged to be performed by each of the assigners AS. Note that the control section for performing the outside-range note processing can be implemented by dedicated hardware circuitry rather than the computer program. The outside-range note processing setting table is prestored in the storage device 15 or the like.

An example of the assignment control processing of FIG. 3 will be described in greater detail with reference to example musical scores shown in FIGS. 6 and 7. Let it be assumed here that the assigner setting table shown in FIG. 4 is employed. The assigner setting table shown in FIG. 4 is intended for a wind instrument quintet.

FIG. 6 shows an example musical score showing key depression state changes in a performance executed by a user using the performance operator unit (keyboard) 22. As the user plays the keyboard in such a manner as shown in the example musical score of FIG. 6, each of the assigners AS selects target depressed keys each time the key depression state changes, and then it determines which of the target depressed keys should be sounded with priority. Then, a tone of the determined depressed key is generated with a tone color set in the assigner AS.

Figure 7:
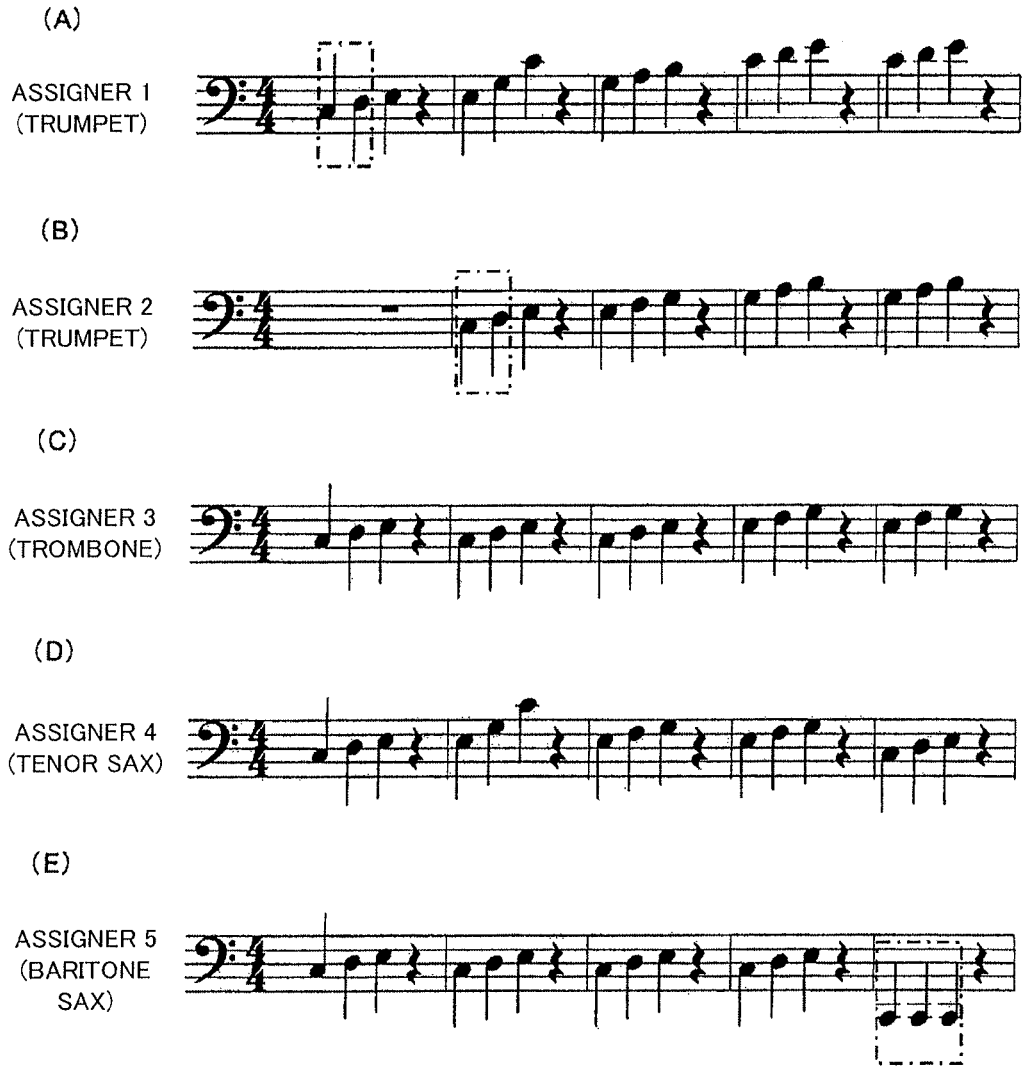
FIG. 7 shows musical scores showing respective tone generation states of assigners AS(1) to AS(5) as a result of the assignment control processing performed on the musical score shown in FIG. 6.

FIG. 7 shows musical scores showing tone generation states of the assigners AS(1) to AS(5) as a result of the assignment control processing performed on the musical score shown in FIG. 6. Note that, for convenience, the assigners AS(1) to AS(5) are depicted as "assigner 1" to "assigner 5" in FIG. 7.

For the assigner AS(1), the "target depressed key" is "all" (all depressed keys), the priority rule is "higher-pitch note priority", the number of tones to be generated is "1", and the tone color is set at "trumpet", as defined in the assigner setting table shown in FIG. 4. When the assigner AS(1) is selected at step S3 of FIG. 3, a determination is made, at step S4, as to whether the target depressed keys of the assigner AS(1) are included in the current key depression state. Because the target depressed keys of the assigner AS(1) are "all", it is always determined that there are target depressed keys, and control proceeds to step S5. At step S5, a tone generating tone pitch of the assigner AS(1) is determined on the basis of the priority rule and the number of tones to be generated. Because the priority rule of the assigner AS(1) is "higher-pitch note priority" and the number of tones to be generated of the assigner AS(1) is "1", one tone of the highest tone pitch in the key depression state is determined as the tone generating tone pitch of the assigner AS(1). After that, the tone of the determined tone generating tone pitch is generated or sounded with the trumpet tone color at step S6.

For the assigner AS(2), the "target depressed key" is "other depressed keys than the highest-pitch depressed key (note)", the priority rule is "higher-pitch note priority", the number of tones to be generated is "1", and the tone color is set at "trumpet", as defined in the assigner setting table shown in FIG. 4. When the assigner AS(2) is selected at step S3 of FIG. 3, a determination is made, at step S4, as to whether the target depressed keys of the assigner AS(2) are included in the current key depression state. If only one key (note) has been performed (first measure in the example musical score), that one key (note) is regarded as the highest-pitch note and thus it is determined that there is no target depressed key, because the target depressed keys of the assigner AS(2) are "other depressed keys than the highest-pitch depressed key (note)". Namely, for the assigner AS(2), no tone is generated when only one key (note) has been performed. Because two or more notes have been performed in the second and subsequent measures of the example musical score, it is determined that there are one or more target depressed keys, so that control proceeds to step S5. At step S5, a tone generating tone pitch of the assigner AS(2) is determined on the basis of the priority rule and the number of tones to be generated. Because the priority rule of the assigner AS(2) is "higher-pitch note priority" and the number of tones to be generated of the assigner AS(2) is "1", a second note from the highest-pitch depressed key (note) is determined as the tone generating tone pitch of the assigner AS(2). After that, a tone of the determined tone generating tone pitch is generated with the trumpet tone color at step S6.

For the assigner AS(3), the "target depressed key" is three depressed keys from the highest-pitch depressed key (note), the priority rule is "lower-pitch note priority", the number of tones to be generated is "1", and the tone color is set at "trombone", as defined in the assigner setting table shown in FIG. 4. When the assigner AS(3) is selected at step S3 of FIG. 3, a determination is made, at step S4, as to whether the target depressed keys of the assigner AS(3) are included in the current key depression state. Because the target depressed keys of the assigner AS(3) are "three depressed keys (notes) from the highest-pitch depressed key (note)", it is determined that there are target depressed keys in all measures, so that control proceeds to step S5. Note that, in the example musical score, the lowest-pitch note in the fourth measure and the second note from the lowest-pitch depressed key (note) are not regarded as the target depressed keys. Then, at step S5, a tone generating tone pitch of the assigner AS(3) is determined on the basis of the priority rule and the number of tones to be generated. Because the priority rule of the assigner AS(3) is "lower-pitch note priority" and the number of tones to be generated of the assigner AS(3) is "1", the lowest-pitch note of the target depressed keys (lowest-pitch note of the depressed keys in the first to third measures, and third note from the highest-pitch note of the target depressed keys in the fourth and fifth measures) is determined as the tone generating tone pitch of the assigner AS(3). Namely, when only one note has been performed, that note is selected as the tone generating tone pitch. When only two notes have been performed, the second note from the highest-pitch note is selected as the tone generating tone pitch of the assigner AS(3). Further, when three or more notes have been performed, the third note from the highest-pitch note is selected as the tone generating tone pitch of the assigner AS(3). After that, a tone of the determined tone generating tone pitch is generated with the trombone tone color at step S6.

For the assigner AS(4), the "target depressed key" is "two depressed keys from the lowest-pitch depressed key (note)", the priority rule is "higher-pitch note priority", the number of tones to be generated is "1", and the tone color is set at "tenor sax", as defined in the assigner setting table shown in FIG. 4. When the assigner AS(4) is selected at step S3 of FIG. 3, a determination is made, at step S4, as to whether the target depressed keys of the assigner AS(4) are included in the current key depression state. Because the "target depressed key" of the assigner AS(4) is "two depressed keys from the lowest-pitch depressed key (note)", it is determined that there are target depressed keys in all of the measures, so that control proceeds to step S5. In the example musical score, the highest-pitch note in the third measure, two notes from the highest-pitch note in the fourth measure and three notes from the highest-pitch note in the fifth measure are not regarded as the target depressed keys. At step S5, a tone generating tone pitch of the assigner AS(4) is determined on the basis of the priority rule and the number of tones to be generated. Because the priority rule of the assigner AS(4) is "higher-pitch note priority" and the number of tones to be generated of the assigner AS(4) is "1", the highest-pitch note of the target depressed keys (highest-pitch note of the depressed keys in the first and second measures, and second note from the lowest-pitch note of the target depressed keys in the third to fifth measures) is determined as the tone generating tone pitch of the assigner AS(4). Namely, when only one note has been performed, that note is selected as the tone generating tone pitch of the assigner AS(4). When two or more notes have been performed, the second note from the lowest-pitch note is selected as the tone generating tone pitch of the assigner AS(4). After that, a tone of the determined tone generating tone pitch is generated with the tenor sax tone color at step S6.

For the assigner AS(5), the "target depressed key" is "all depressed keys", the priority rule is "lower-pitch note priority", the number of tones to be generated is "1", and the tone color is set at "baritone sax", as defined in the assigner setting table shown in FIG. 4. When the assigner AS(5) is selected at step S3 of FIG. 3, a determination is made, at step S4, as to whether the target depressed keys of the assigner AS(5) are included in the current key depression state. Because the "target depressed key" of the assigner AS(5) is "all depressed keys", it is always determined that there are target depressed keys, so that control proceeds to step S5. At step S5, a tone generating tone pitch of the assigner AS(5) is determined on the basis of the priority rule and the number of tones to be generated. Because the priority rule of the assigner AS(5) is "lower-pitch note priority" and the number of tones to be generated of the assigner AS(5) is "1", one note of the lowest-pitch depressed key is determined as the tone generating tone pitch of the assigner AS(5). After that, a tone of the determined tone generating tone pitch is generated with the baritone sax tone color at step S6.

First two notes (surrounded by one-dot-dash line) in the first measure of the assigner AS(1), first two notes (surrounded by one-dot-dash line) in the second measure of the assigner AS(2) and three notes (surrounded by one-dot-dash line) in the fifth measure of the assigner AS(5) are all of tone pitches not included in ranges (tone pitch ranges) of the raw musical instruments corresponding to the tone colors set for the assigners AS in question. For these tone pitches, however, natural performances similar to those executed by the raw (natural) musical instruments can be provided by processing performed with reference to the outside-range note processing setting table shown in FIG. 5. For example, because the outside-range note processing setting table of FIG. 5 defines that the tone color of the trumpet be sounded as designated even for a tone pitch outside the range, the first two notes (surrounded by one-dot-dash line) in the first measure of the assigner AS(1) and the first two notes (surrounded by one-dot-dash line) in the second measure of the assigner AS(2) are sounded at the tone pitches indicated in the example musical score. Further, for the baritone sax, the outside-range note processing setting table of FIG. 5 defines that a tone pitch outside the range be octave-shifted, the three notes of "C1" (surrounded by one-dot-dash line) in the fifth measure of the assigner AS(5) are raised by one octave so as to fall within the range because "C1" is lower than the range (D1-F#3) of the baritone sax; thus, these three notes of "C1" are sounded as tones of "C2". Thus, by performing the outside-range note processing, the instant embodiment can realize a more natural ensemble performance with the respective characteristics of the raw musical instruments taken into account.

Next, with reference to example musical scores shown in FIGS. 8 and 9, a detailed description will be given about a modified example of the assignment control processing shown in FIG. 3. Let it be assumed here that an assigner setting table shown in FIG. 10 is employed in this modified assignment control processing. The modified assignment control processing will be described in relation to a stringed instrument ensemble performance.

Figure 8:
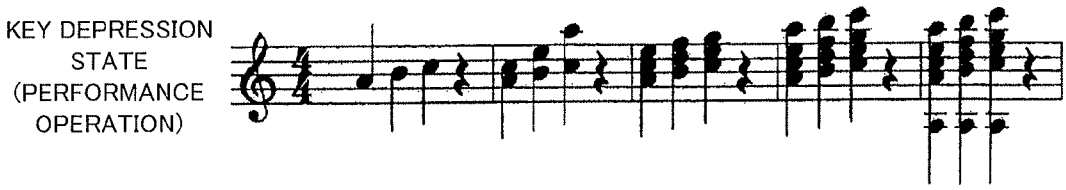
FIG. 8 shows a musical score depicting another example of the key depression states explanatory of the assignment control processing performed in the embodiment of the present invention.

FIG. 8 shows a musical score depicting key depression states explanatory of the modified assignment control processing, and FIG. 9 shows musical scores showing tone generation states of the assigners AS(1) to AS(3) as a result of the modified assignment control processing performed on the musical score shown in FIG. 8. Note that the assigners AS(1) to AS(3) are shown as "assigner 1" to "assigner 3" for convenience. Further, FIG. 10 shows another example of the assigner setting table used in the instant embodiment of the invention. Target depressed keys, priority rules, numbers of tones to be generated and tone colors are defined for the individual assigners AS in the assigner setting table of FIG. 10, like in the assigner setting table of FIG. 4.

For the assigner AS(1), the "target depressed key" is "all depressed keys", the priority rule is "higher-pitch note priority", the number of tones to be generated is "1", and the tone color is set at "violin", as defined in the assigner setting table shown in FIG. 10. When the assigner AS(1) is selected at step S3 of FIG. 3, a determination is made, at step S4, as to whether the target depressed keys of the assigner AS(1) are included in the current key depression state. Because the "target depressed key" of the assigner AS(1) is "all" (all depressed keys), it is always determined that there are target depressed keys, so that control proceeds to step S5. At step S5, a tone generating tone pitch of the assigner AS(1) is determined on the basis of the priority rule and the number of tones to be generated of the assigner AS(1). Because the priority rule of the assigner AS(1) is "higher-pitch note priority" and the number of tones to be generated of the assigner AS(1) is "1", one tone of the highest-pitch in the key depression state is determined as the tone generating tone pitch of the assigner AS(1). After that, a tone of the determined tone generating tone pitch is generated with the violin tone color at step S6.

For the assigner AS(2), the "target depressed key" is "other depressed keys than the highest-pitch depressed key (note)", the priority rule is "last-depressed key priority", the number of tones to be generated is limitless, and the tone color is set at "strings", as defined in the assigner setting table shown in FIG. 10. When the assigner AS(2) is selected at step S3 of FIG. 3, a determination is made, at step S4, as to whether the target depressed keys of the assigner AS(2) are included in the current key depression state. If only one key (note) has been performed (first measure in the example musical score), that one key (note) is regarded as the highest-pitch note and thus it is determined that there is no target depressed key, because the "target depressed key" of the assigner AS(2) is "other depressed keys than the highest-pitch depressed key (note)". Namely, for the assigner AS(2), no tone is generated when only one key (note) has been performed. Because two or more notes have been performed in the second and subsequent measures of the example musical score, it is determined that there are target depressed keys, so that control proceeds to step S5. At step S5, a tone generating tone pitch of the assigner AS(2) is determined on the basis of the priority rule and the number of tones to be generated of the assigner AS(2). Because the priority rule of the assigner AS(2) is "last-depressed key priority" and the number of tones to be generated of the assigner AS(2) is "limitless", all notes (all target depressed keys) but (except for) the highest-pitch note in the key depression state are determined as the tone generating tone pitches of the assigner AS(2). After that, tones of the determined tone generating tone pitches are generated with the strings tone color at step S6. In the case where the priority rule is "last-depressed key priority and if the number of tones to be generated is not limitless, notes corresponding to the number of tones to be generated are sequentially determined, as the tone generating tone pitches, from the last-depressed key in accordance with an order of the depressed keys included in the key depression state.

In this example, the number of tones to be generated is limitless because the tone color set for the assigner AS(2) is "strings". Namely, because the strings is, by its nature, a tone color made by mixing tones of a plurality of stringed instruments, there is no need to execute monophonic tone generation. Where the tone color is set at "violin" or "contrabass" as in the assigner AS(1) or the assigner AS(3), settings are made such that only one tone is generated even when a plurality of keys have been simultaneously depressed, because the "violin" and "contrabass" are each a musical instrument that generally does not simultaneously generate two or more notes. Where the tone color is set at "strings", on the other hand, settings can be made such that a plurality of tones are generated when a plurality of keys have been simultaneously depressed.

For the assigner AS(3), the "target depressed key" is "other depressed keys than the highest-pitch depressed key (note)", the priority rule is "lower-pitch note priority", the number of tones to be generated is "1", and the tone color is set at "contrabass", as defined in the assigner setting table shown in FIG. 10. When the assigner AS(3) is selected at step S3 of FIG. 3, a determination is made, at step S4, as to whether the target depressed keys of the assigner AS(3) are included in the current key depression state. It is determined that there is no target depressed key when only one key (note) has been performed (first measure in the example musical score), because the "target depressed key" of the assigner AS(3) is "other depressed keys than the highest-pitch depressed key (note)" and because that key (note) is regarded as the highest-pitch note. Namely, for the assigner AS(3), no tone is generated when only one key (note) has been performed. In the second and subsequent measures of the example musical score where two or more notes have been performed, it is determined that there are target depressed keys, so that control proceeds to step S5. At step S5, a tone generating tone pitch of the assigner AS(3) is determined on the basis of the priority rule and the number of tones to be generated of the assigner AS(3). Because the priority rule of the assigner AS(3) is "lower-pitch note priority" and the number of tones to be generated of the assigner AS(3) is "1", one note of the lowest tone pitch in the key depression state is determined as the tone generating tone pitch of the assigner AS(3). Then, at step S6, a tone of the determined tone generating tone pitch is generated with the contrabass tone color.

Note that tone pitches in the third and fourth measures of the assigner AS(3) are each not included in the range of a raw musical instrument corresponding to the tone color (contrabass) set in the assigner AS(3). For these tone pitches, however, a natural performance similar to that executed by the raw (natural) musical instrument can be realized by processing performed with reference to an outside-range note processing setting table shown in FIG. 11.

FIG. 11 shows another example of the outside-range note processing setting table used in the instant embodiment of the invention. In the outside-range note processing setting table of FIG. 11, tone colors, ranges of the tone colors, outside-range note processing, volumes, etc. are defined for the individual assigners AS, like in the setting table of FIG. 5. In the illustrated example of FIG. 11, the range of the "violin" tone color is defined as "G2-A5", and, when there has been given a tone generating instruction designating a tone pitch outside the range for the "violin" tone color, the tone pitch is "sounded as designated". Note that the volume is set at "100" for the "violin" tone color. Further, no range is set for the "strings" tone color, and there is no setting to be applied when there has been given a tone generating instruction designating a tone pitch outside the range for the "strings" tone color. This is because the strings tone color is, by its nature, a tone color made by mixing tones of a plurality of stringed instruments as noted above and thus has no particular range. Note that the volume is set at "64" for the "strings" tone color. The range of the "contrabass" tone color is defined as "E0-F3", and when there has been given a tone generating instruction designating a tone pitch outside the range, the tone pitch outside the range is ignored (i.e., no tone is generated). Note that the volume is set at "64" for the "contrabass" tone color.

According to the outside-range note processing setting table shown in FIG. 11, tone pitches outside the range of the contrabass tone color set for the assigner AS(3) are ignored (i.e., tones of these tone pitches are not generated). Thus, tone pitches outside the range in the second to fourth measure of the assigner AS(3) are ignored. However, tone pitch "A2" in the fifth measure is sounded because it is within the range.

According to the above-described embodiment of the present invention, each of the assigners AS determines target depressed keys independently of the other assigners AS. Then, on the basis of the priority rule (high-tone-pitch note priority, last-depressed key priority, or the like) and in accordance with the number of tones to be generated, the assigner AS determines, from among the determined target depressed keys, a depressed key (tone pitch) to be sounded.

By setting a specific target depressed key determination rule for each of the assigners AS as set forth above, a tone color to be sounded always with priority (tone color to be sounded each time a key has been depressed) and a tone color to be sounded only when more than a predetermined number of keys have been depressed can be set separately from each other.

Further, by setting a specific priority rule and a specific number of tones to be generated for each of the assigners AS as set forth above, tones that appropriately match characteristics of individual musical instruments can be generated. Thus, by combining a plurality of assigners AS that can be set independently of one another as set forth above, the instant embodiment can achieve a natural ensemble performance using a plurality of musical instruments differing from one another in characteristic.

So far, the embodiment of the present invention has been described in relation to the case where rules for sequentially selecting or excluding some notes in accordance with a predetermined order (e.g., descending or ascending order of tone pitches), such as "all", "all but the highest-pitch depressed key (note)" or "two keys from the lowest-pitch depressed key (note)", are employed as selection rules for selecting target depressed keys of the assigners AS. Alternatively, the target depressed keys may be selected in accordance with any desired combination of such different selection rules. The following describe, as a specific example, a case in which a selection condition of at least one of the assigners AS comprises a combination of two selection rules of "excluding the highest-pitch depressed key (note)" (namely, "all but the highest-pitch note") and "excluding the lowest-pitch depressed key (note)" (namely, "all but the lowest-pitch note"). According to such a combination, the highest-pitch depressed key (note) and the lowest-pitch depressed key (note) are excluded, and thus, when the number of simultaneously depressed keys is "1" or "2", it is determined that there is "no" target depressed key. Namely, in such a case, the assigner in question does not assign the tone color to any one of the depressed keys and thus does not assign tone generation to any one of the depressed keys; namely, no tone generation is performed via the assigner AS in question. Further, when the number of simultaneously depressed keys is "3", a middle one of the three depressed keys, i.e. one depressed key between the highest-pitch depressed key and the lowest-pitch depressed key, is selected as the target depressed key, and a tone or note of the selected target depressed key is sounded. Further, when the number of simultaneously depressed keys is "4" or more, a plurality of keys corresponding to intermediate tone pitches of the depressed keys are selected as the target depressed keys, and one or more of the selected target depressed keys are determined in accordance with a predetermined priority order. Thus, in this example, no tone is generated when the number of simultaneously depressed keys is "2" or less, and when the number of simultaneously depressed keys is "3" or more, the tone generation assignment is permitted such that a particular depressed key corresponding to an intermediate tone pitch (if there are a plurality of such particular depressed keys, any one of the particular depressed keys that has a higher priority than the others) can be subjected to the tone generation assignment.

The following describe, as another specific example, a case in which the selection condition of at least one of the assigners AS comprises a combination of two selection rules of "excluding the highest-pitch depressed key (note)" (namely, "all but the highest-pitch note") and "up to two keys from the highest-pitch depressed key (note)". According to this combination of the two selection rules, the highest-pitch depressed key (note) is excluded, and thus, when the number of simultaneously depressed keys is "1", it is determined that there is "no" target depressed key. Namely, in such a case, the assigner in question does not assign the tone color to any one of the depressed keys and thus does not assign tone generation to any one of the depressed keys; namely, no tone generation is performed via the assigner AS. Further, when the number of simultaneously depressed keys is "2" or more, one of two depressed keys from the highest-pitch depressed key (note) which is other than the highest-pitch depressed key (note), i.e. the depressed key of the second highest tone pitch of all of the simultaneously depressed keys, is selected as the target depressed key. Thus, in this example, no tone is generated when the number of simultaneously depressed keys is "1", and when the number of simultaneously depressed keys is "2" or more, the tone generation assignment is permitted such that the tone color is always assigned to the depressed key of the second highest tone pitch so that a tone of the pitch corresponding to the tone-color-assigned depressed key is generated. Thus, by selecting a target depressed key in accordance with a combination of a plurality of selection rules, any particular key to which the tone color of the assigner is to be assigned can be selected in a more precise manner.

Further, the above-described embodiment is constructed to perform the processes for determining one or more tone pitches to be sounded for each of the assigners AS(1) and AS(n) (i.e., the processes at steps S4 and S5 for selecting target tone pitches to which a tone color is to be assigned by the assigner AS and then determining one or more tone pitches of which tones are to be generated with the tone color assigned by the assigner AS). Alternatively, in a case where the same target depressed key selection rule and the same priority rule are set for two or more of the assigners, the aforementioned processes may be performed by only one of the assigners. Because a same tone pitch is sounded by the assigners having the same settings, a tone pitch determined on the basis of execution of the process by one assigner may be applied to another assigner set in the same manner as the one assigner so that a tone color is assigned to the determined tone pitch by the other assigner.

Furthermore, whereas the embodiment of the present invention has been described above in relation to the case where the assigners have their respective target depressed key selection rules and priority rules, such assigners may be used in combination with one or more assigners having no such rules. More specifically, according to a modified embodiment of the present invention, the basic principles of the invention may be applied to only some of the assigners so that these assigners determine tone pitches on the basis of the target depressed key selection rule, priority rule and the number of tones to be generated, and the remaining assigner(s) may not have the target depressed key selection rule so that tone pitches can be determined on the basis of only the priority rule.

It should be appreciated that the above-described embodiments of the present invention may be implemented, for example, by a commercially available computer having installed therein computer programs etc. corresponding to the embodiments, rather than by an electronic musical instrument. In such a case, the computer programs etc. corresponding to the embodiments may be supplied to users in computer-readable recording media, such as CD-ROMs. Further, in a case where the computer etc. are connected to a communication network, such as a LAN, the Internet or a telephone network, the computer programs, various data, etc. may be supplied to users via the communication network.

Finally, although the present invention has been described above in relation to the embodiments, the present invention is not limited to the embodiments and may be modified and improved variously, and various combinations of the above-described embodiments are also possible.

What is claimed is:

1. A tone generation assigning apparatus comprising:

a reception section configured to receive one or more tone generation instructions designating one or more tone pitches; and a plurality of assigners each configured to assign a tone color to the one or more tone pitches designated by the one or more tone generation instructions received by said reception section, each of said plurality of assigners configured to determine whether the one or more tone pitches designated by the one or more tone generation instructions received by said reception section include one or more target tone pitches to which the tone color is to be assigned by the respective assigner and to select, from among the one or more tone pitches designated by the one or more tone generation instructions received by said reception section, the one or more target tone pitches to which the tone color is to be assigned by the respective assigner, and each of said plurality of assigners configured to determine, on the basis of a priority order set for the respective assigner, from among the selected one or more target tone pitches, one or more tone pitches of which tones are to be generated with the tone color assigned by the respective assigner.

2. The tone generation assigning apparatus as claimed in claim 1, wherein each of the plurality of assigners is configured to select, in accordance with a selection rule for selecting target tone pitches to which the tone color is to be assigned by the respective assigner, a predetermined number of tone pitches, as the target tone pitches, in a descending or ascending order of tone pitches from among the one or more tone pitches designated by the one or more tone generation instructions received by said reception section.

3. The tone generation assigning apparatus as claimed in claim 1, wherein each of the plurality of assigners is configured to select, in accordance with a selection rule for selecting target tone pitches to which the tone color is to be assigned by the respective assigner, one or more tone pitches remaining as a result of excluding, from the one or more tone pitches of the one or more tone generation instructions received by said reception section, a predetermined number of tone pitches from a highest or lowest pitch of the one or more tone pitches designated by the one or more tone generation instructions.

4. The tone generation assigning apparatus as claimed in claim 1, wherein at least one of said assigners is configured to select, in accordance with a combination of a plurality of different selection rules, the one or more tone pitches which the tone color is to be assigned by the at least one assigner.

5. The tone generation assigning apparatus as claimed in claim 1, which further comprises a tone generator configured to generate tones of the one or more tone pitches, determined by the respective assigner, with the tone color assigned by the respective assigner.

6. The tone generation assigning apparatus as claimed in claim 1, wherein a soundable range is predefined for the tone color assigned by the respective assigner, and which further comprises a control section which, when the one or more tone pitches of which it has been determined that tones are to be generated with the tone color assigned by the respective assigner are outside the soundable range of the tone color assigned by the respective assigner, controls a tone generation mode of the tones corresponding to the tone pitches.

7. The tone generation assigning apparatus as claimed in claim 6, wherein, when the one or more tone pitches of which it has been determined that tones are to be generated with the tone color assigned by the respective assigner are outside the soundable range of the tone color assigned by the respective assigner, said control section octave-shifts said one or more tone pitches so that said one or more tone pitches fall within the soundable range of the tone color.

8. The tone generation assigning apparatus as claimed in claim 6, wherein, when the one or more tone pitches of which it has been determined that tones are to be generated with the tone color assigned by the respective assigner are outside the soundable range of the tone color assigned by the respective assigner, said control section inhibits generation of the tones of said one or more tone pitches.

9. The tone generation assigning apparatus as claimed in claim 1, which includes a table that defines, in correspondence with each of the plurality of assigners, the tone colors to be assigned by the each of the plurality of assigners, conditions for selecting the tone pitches to which the tone colors are to be assigned by the each of the plurality of assigners and the priority orders, and wherein the priority order of each of the plurality of assigners is defined by a combination of a priority rule and a number of tones to be simultaneously generatable with the tone color assigned by the respective assigner.

10. The tone generation assigning apparatus as claimed in claim 9, wherein at least one of the tone color, the condition and the priority order defined in the table can be variably set.

11. The tone generation assigning apparatus as claimed in claim 5, further comprising an output section configured to audibly output the generated tones.

12. A non-transitory computer-readable medium containing a group of instructions executable by a processor to perform a method for assigning tone generation, the method comprising:

receiving one or more tone generation instructions designating one or more tone pitches;

determining, for each of a plurality of assigners that is configured to assign a tone color to the one or more tone pitches designated by the received tone generation instructions, whether the one or more tone pitches designated by the one or more tone generation instructions include one or more target tone pitches to which the tone color is to be assigned by the respective assigner and selecting, for each of the plurality of assigners that is configured to assign the tone color to the one or more tone pitches designated by the received tone generation instructions, the one or more target tone pitches to which the tone color is to be assigned by the respective assigner from among the one or more tone pitches designated by the received one or more tone generation instructions; and determining, for each of the plurality of assigners and on the basis of a priority order set for the respective assigner, from among the selected one or more target tone pitches, one or more tone pitches of which tones are to be generated with the tone color assigned by the respective assigner.

13. The non-transitory computer-readable medium of claim 12, wherein the method further comprises generating and audibly outputting tones of the one or more tone pitches, determined by the respective assigner, with the tone color assigned by the respective assigner.

14. A computer-implemented method comprising:

receiving one or more tone generation instructions designating one or more tone pitches;

determining, for each of a plurality of assigners that is configured to assign a tone color to the one or more tone pitches designated by the received tone generation instructions, whether the one or more tone pitches designated by the one or more tone generation instructions include one or more target tone pitches to which the tone color is to be assigned by the respective assigner and selecting, for each of the plurality of assigners that is configured to assign the tone color to the one or more tone pitches designated by the received tone generation instructions, the one or more target tone pitches to which the tone color is to be assigned by the respective assigner from among the one or more tone pitches designated by the received one or more tone generation instructions; and determining, for each of the plurality of assigners and on the basis of a priority order set for the respective assigner, from among the selected one or more target tone pitches, one or more tone pitches of which tones are to be generated with the tone color assigned by the respective assigner.

15. The method of claim 14, further comprising generating and audibly outputting tones of the one or more tone pitches, determined by the respective assigner, with the tone color assigned by the respective assigner.

* * * * *